United States Patent [19]

Taylor

[11] 4,171,642

[45] Oct. 23, 1979

[54] FLUID PRODUCING FORMATION TESTER

[76] Inventor: Julian S. Taylor, 8300 SW. 8, Oklahoma City, Okla. 73108

[21] Appl. No.: 897,889

[22] Filed: Apr. 19, 1978

[51] Int. Cl.[2] ..... E21B 47/00

[52] U.S. Cl. ..... 73/155

[58] Field of Search ..... 73/155, 152

[56] References Cited

U.S. PATENT DOCUMENTS

| | | | |
|---|---|---|---|
| 2,377,501 | 6/1945 | Kinley | 73/155 |
| 2,965,753 | 12/1960 | Reynolds et al. | 73/155 |
| 3,103,813 | 9/1963 | Bourne et al. | 73/155 |
| 3,908,454 | 9/1975 | Mullins et al. | 73/155 |

*Primary Examiner*—Anthony V. Ciarlante
*Attorney, Agent, or Firm*—Robert K. Rhea

[57] ABSTRACT

An elongated housing, capable of being lowered into a cased borehole and sealed at its respective ends, at predetermined locations, with the inside surface of the casing, is longitudinally provided with a fluid bypass tube. Fluid, from casing perforations communicating with a fluid producing formation, enters the housing through a lateral inlet port in its depending end wall and flows from the upper end of the housing into the casing annulus through a ball check valve equipped port. Flow rate and thermal conductivity sensing probes, contained by the housing, are supplied with energy and connected with instruments at the surface of the earth for comparing probe data with known data obtained from the borehole fluid passing through a flow line connected with the casing at the earth's surface.

1 Claim, 1 Drawing Figure

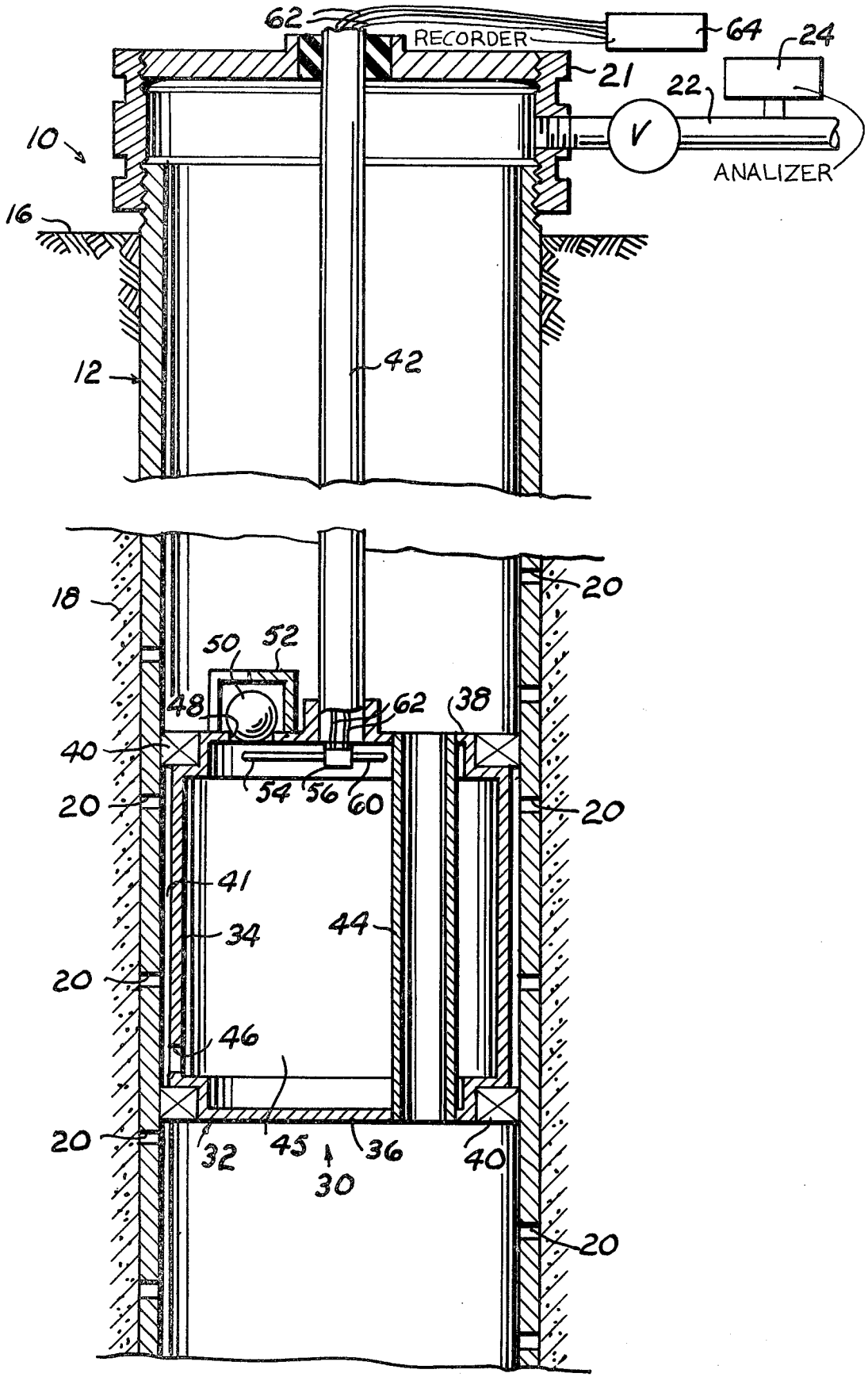
62
RECORDER
64
24
21
22
V
ANALIZER
10
16
12
42
18
20
50
52
48
62
38
40
54
56
60
41
34
44
46
32
45
36
30

FLUID PRODUCING FORMATION TESTER

BACKGROUND OF THE INVENTION

1. Field of the Invention

The present invention relates to borehole fluid producing formation testers and more particularly to flow rate and thermal conductivity sensing apparatus of fluid entering a borehole through casing perforations.

While drilling a borehole in seeking oil or gas production a log is kept of the various earth formations drilled through. The borehole is usually cased and thereafter the casing wall is perforated in those areas intersecting selected potential fluid producing formations. After perforating the casing it is desirable to determine the flow rate and what kind of fluid (oil, water or gas) is entering the casing through the casing perforations at selected vertically spaced positions. This invention provides an apparatus for accomplishing this purpose.

2. Description of the Prior Art

I do not know of any patents disclosing an apparatus of this type.

SUMMARY OF THE INVENTION

An elongated closed end cylindrical housing, diametrically slightly smaller than the inside diameter of the casing in a borehole, is provided with a coextensive tube forming a fluid passageway through the housing and lowered into the casing. Seals, supported by the respective ends of the housing, seal the housing ends fluid tight with the inside surface of the casing in spanning relation with respect to vertically spaced perforations in the casing providing communication between the casing annulus and a potential fluid producing formation. An inlet port, in the housing wall adjacent the lowermost housing seal, permits fluid from a producing formation to fill the housing and flow upwardly out of the housing into the casing annulus through an outlet port in the upper end of the housing normally closed by a ball check valve. A fluid flow sensing probe is disposed within the housing in the path of fluid flow through the outlet port and a thermal conductivity sensing probe is mounted within the housing in diametric opposition to the fluid flow sensing probe. Wiring, supported by the line, supplies a source of electrical energy to resistance heaters in the probes and connects the data output of the probes with instruments at the earth's surface. A fluid analyzing unit is connected with a flow line connected with the casing at the surface of the earth, through which fluid from the borehole passes, for obtaining flow line fluid data and comparing such known data with the probe data determining the temperature flow rate and type of fluid (oil, water or gas) entering the casing through the perforations spanned by the housing.

The principal object of this invention is to provide an apparatus for determining the flow rate and type of fluid, water, oil or gas, entering the borehole through casing perforations from a fluid producing formation at selected vertically spaced positions.

BRIEF DESCRIPTION OF THE DRAWING

The single FIGURE is a diagrammatic and vertical cross sectional view.

DESCRIPTION OF THE PREFERRED EMBODIMENT

Like characters of reference designate like parts in those figures of the drawings in which they occur.

In the drawing:

The reference numeral 10 indicates a fluid producing well having a casing 12 extending above the surface of the earth 16 and intersecting one or more fluid producing earth formations 18, the casing being provided with perforations 20 extending through its wall in the area of the earth formation 18. The fluid, such as oil, water and gas, not shown, from the earth formation 18, flows into the casing annulus through the perforations 20. Adjacent the surface of the earth, the casing is provided with a casing head 21, or the like, in turn connected with a valve equipped flow line 22 in a conventional manner. A fluid analyzing means 24 is connected with the flow line 22. The fluid analyzing means 24 determines the temperature, flow rate and thermal conductivity of each fluid component (oil, water or gas) produced by the well.

The reference numeral 30, indicates the device, as a whole, comprising a generally cylindrical hollow housing 32 of a selected length having an outside diameter, defined by its side wall 34, freely received within the casing 12. The respective end of the housing 32 is closed by end walls 36 and 38. The respective end portion of the housing is provided with conventional sealing means, such as a packer 40, for sealing the respective end portions of the housing wall 34 fluid tight with the inner surface of the casing 12 and forming an annulus 41 around the housing. A wire line 42 is connected with the upper end wall 38 of the housing for running it into the well and selectively raising and lowering it with respect to the casing perforations 20, as presently explained.

Obviously, tubing, not shown, may be used instead of the line 42.

A tube 44, open at both ends, extends vertically through the housing ends 36 and 38 in axial off-set relation to form a first passageway or fluid bypass through the housing for the purposes believed apparent.

Adjacent its depending end but spaced upwardly from the lowermost packer 40, the housing wall 34 is provided with an inlet port 46, diametrically opposite the position of the tube 44, to permit fluid within the annulus 41, from one or more of the casing perforations 20 spanned by the length of the housing, to enter the housing chamber 45. The housing upper end wall 38 is provided with an outlet port 48, perferably disposed above the position of the inlet port 46, to form a second or fluid current passageway between the inlet and outlet ports 46 and 48; through the housing chamber 45 along its wall diametrically opposite the tube 44. The outlet port 48 is normally closed by a ball valve 50 contained by a cage 52, secured in upstanding relation to the housing end 38 to form a check valve which permits fluid entering the housing chamber 45 to flow upwardly into the casing annulus above the housing.

A fluid flow sensing probe 54, such as is disclosed by my U.S. Pat. No. 4,016,758, is supported at one end by a probe support 56 coaxially disposed within the housing adjacent the inner surface of the housing end 38. The other or free end of the probe 54 is disposed in the path of fluid passing from the housing chamber 45 through the outlet port 48. A second similar thermal conductivity sensing probe 60, supported by the probe support 56, projects in a direction opposite the first probe 54.

Each of the probes 54 and 60 are a thermal type flowmeter containing an electrical resistance heater for heating the probe tip to a predetermined temperature at a given input wattage when the probe is disposed in fluid. A thermocouple is disposed within the probe heater. With the predetermined heater wattage known, the voltage output of the thermocouple is inversely proportionate to the heat loss to the fluid thus revealing the mass flow rate of the fluid passing through the housing 32 when the temperature is known or compensated for.

A plurality of wires 62, connected with recording apparatus 64 at the earth's surface, extend into the casing and are supported by the wire line 42 for respective connection with the probe heaters and thermocouples for supplying electrical energy thereto and recording thermocouple values.

OPERATION

In operation, the device 30 is run to a predetermined depth into the casing 12 in a conventional manner. The packers 40 are "set" to seal with the inside surface of the casing. The data from the probe thermocouples is compared with the results of the well fluid analyzing means 24 thus revealing the kind of fluid or fluids (oil, water or gas) and the flow rate thereof entering the housing from the casing perforations 20 at that position of the housing. The device 30 is progressively moved, after releasing the packers 40 and again sealed with the casing 12, in step by step fashion throughout the vertical distance of the potential producing formations being tested.

Obviously the invention is susceptible to changes or alterations without defeating its practicability. Therefore, I do not wish to be confined to the preferred embodiment shown in the drawings and described herein.

I claim:

1. A fluid testing device for a cased fluid producing well having vertically spaced perforations in the casing wall adjacent a fluid producing formation and having fluid flow and temperature sensing means connected with a casing connected flow line at the earth's surface, the improvement comprising:

an elongated housing having a side wall and closed end walls freely movable vertically within said casing;

a tube extending vertically through said housing for forming a first fluid passageway permitting well fluid flow to the flow line from below said housing, said housing having a second fluid passageway defined by an inlet port in the depending end portion of its side wall and an outlet port in its upper end wall above the position of the inlet port;

a check valve normally closing the outlet port;

means for raising and lowering said housing within the casing;

means for releaseably sealing the respective end portions of said housing fluid tight with the inside surface of said casing;

fluid sensing means comprising a thermal type flowmeter within said housing having a first fluid responsive probe adjacent the outlet intersecting the stream of well fluid flowing through said second fluid passageway and having a second fluid responsive probe projecting in a direction opposite and terminating remote from said first probe; and, conductors connecting said flowmeter with a source of electrical energy and recording instruments at the surface of the earth.

* * * * *